US005227081A

United States Patent [19]

Sawa et al.

[11] Patent Number: 5,227,081

[45] Date of Patent: Jul. 13, 1993

[54] SILICONE GREASE COMPOSITION AND METHOD FOR PREPARING SAME

[75] Inventors: Kiyotaka Sawa; Yasushi Sugiura, both of Ichihara; Osamu Tanaka, Chiba, all of Japan

[73] Assignee: Dow Corning Toray Silicone Co., Ltd., Tokyo, Japan

[21] Appl. No.: 840,425

[22] Filed: Feb. 24, 1992

[30] Foreign Application Priority Data

Feb. 22, 1991 [JP] Japan ..... 3-050696

[51] Int. Cl.[5] ..... C10M 107/50; C10M 113/00; C10M 119/22

[52] U.S. Cl. ..... 252/28; 252/29; 252/30; 252/25; 252/49.6; 252/58

[58] Field of Search ..... 252/28, 25, 49.6, 30, 252/29; 524/492, 493, 588

[56] References Cited

U.S. PATENT DOCUMENTS

| | | | |
|---|---|---|---|
| 2,645,588 | 7/1953 | Barry | 252/49.6 |
| 3,145,175 | 8/1964 | Wright | 252/28 |
| 4,820,510 | 4/1989 | Arraudeau et al. | 424/63 |
| 4,840,742 | 6/1989 | Hoffman | 252/28 |
| 4,970,252 | 11/1990 | Sakuta et al. | 524/268 |
| 4,983,701 | 2/1991 | Hara et al. | 528/15 |
| 4,987,169 | 1/1991 | Kuwata et al. | 524/267 |
| 5,064,891 | 11/1991 | Fujiki et al. | 524/588 |

FOREIGN PATENT DOCUMENTS

| | | |
|---|---|---|
| 51-55870 | 5/1976 | Japan . |
| 57-36302 | 8/1982 | Japan . |
| 62-43492 | 2/1987 | Japan . |
| 2-212556 | 8/1990 | Japan . |

*Primary Examiner*—Prince Willis, Jr.
*Assistant Examiner*—Alan D. Diamond
*Attorney, Agent, or Firm*—Robert Spector

[57] ABSTRACT

Silicone grease compositions are prepared by blending a thickening agent with a liquified crosslinked organosiloxane gel produced using a platinum-catalyzed hydrosilylation reaction. The gel is liquified by application of a shearing force to the crosslinked gel. The shearing force can be applied prior to and/or during blending of the gel with the thickener.

8 Claims, No Drawings

SILICONE GREASE COMPOSITION AND METHOD FOR PREPARING SAME

BACKGROUND OF THE INVENTION

1. Field of the Invention

The present invention relates to silicone grease compositions and to a method for preparing these compositions. More specifically, this invention relates to silicone grease compositions exhibiting little oil bleed even upon long-term standing at elevated temperatures. The present invention also relates to a method for preparing these compositions utilizing shear-induced liquefaction of a crosslinked organosiloxane gel.

2. Background Information

Silicone grease compositions prepared by blending a thickener such as finely divided silica, diatomaceous earth, zinc oxide, or titanium oxide into liquid organosiloxanes referred to as silicone oils are distinguished by an excellent water repellency, resistance to moisture, dust and corrosion, lubrication performance, sealing capacity, and electric insulation performance. As a consequence, they have been used as lubricants and corrosion inhibitors for rubbing contacts such as switches and tuners; as insulating agents, water repellents, and lubricants for cable connectors; and to inhibit damage to electric insulators resulting from salt and dust.

In addition, silicone grease compositions prepared by blending a thickener such as alumina, boron nitride, or aluminum nitride into silicone oil have an excellent thermal conductivity and as a consequence are employed as heat-conducting fillers between a heat-generating solid state electronic device such as transistor, diode, or rectifier and a heat-radiating plate.

The preceding silicone grease compositions are prepared by blending a silicone oil with a thickener which has little affinity for the silicone oil. As a result, the silicone oil will separate or bleed from such a silicone grease composition when it is held for extended periods of time at high temperatures or when it is repeatedly subjected to alternating cooling and heating cycles over long periods of time.

Oil separation is a particularly frequent problem associated with the use of the highly thermally conductive thickeners that exhibit relatively large particle sizes. This problem has prompted a number of investigations into low-bleed silicone grease compositions, and the following compositions, for example, have been described:

- a silicone grease composition composed of straight-chain and/or cyclic organopolysiloxane and thickener in Japanese Patent Application Laid Open [Kokai or Unexamined] Number 51-55870 [55,870/76]),
- a thixotropic, thermally conductive material composed of liquid organosilicone carrier, filler powder which imparts thermal conductivity (selected from lamellar aluminum nitride, dendritic zinc oxide, lamellar boron nitride, and their mixtures), and silica fiber functioning as bleed inhibitor, in Japanese Laid Open Patent Application 57-36302 [36,302/82],
- a thermally conductive silicone grease composition composed of polyorganosiloxane, silicon carbide, and fumed silica, in Japanese Laid Open Patent Application Number 62-43492 [43,492/87], and
- a thermally conductive silicone oil compound composed of hydroxyl-containing organopolysiloxane and at least 1 microparticulate metal compound selected from zinc white, alumina, aluminum nitride, and silicon nitride, in Japanese Patent Application Laid Open Number 2-212556 [212,556/90].

In another approach to the preparation of silicone grease compositions, U.S. Pat. No. 4,987,169, issued on Jan. 22, 1991 teaches preparing a silicone composition in powder, paste, or grease form by the application of a shearing force to the polymer product obtained by the addition polymerization in the presence of a low-viscosity silicone oil of an organohydrogenpolysiloxane with organopolysiloxane containing silicon-bonded, ethylenically unsaturated groups.

The silicone grease compositions disclosed in both Japanese Patent Publication Number 57-36302 and Japanese Laid Open Patent Application Number 62-43492 exhibit relatively low thermal conductivities. This is due to the addition of silica fiber or fumed silica, which requires a reduction in the amount of addition of the highly thermally conductive filler that can be present in the composition.

Even though the silicone grease compositions disclosed in Japanese Patent Application Laid Open Numbers 51-55870 and 2-212556 employ special organopolysiloxanes, these compositions still do not offer a satisfactory reduction in the oil bleed or oil separation.

Finally, the preparative method described in U.S. Pat. No. 4,987,169 has the disadvantage of a large oil bleed due to the presence of the low-viscosity silicone oil in the final composition.

The present invention was developed as the result of extensive investigations by the present inventors for the purpose of solving the problems associated with prior art grease compositions.

An objective of the present invention is to provide a silicone grease composition wherein the amount of oil that bleeds or separates from the composition is equivalent to less than 1 percent by weight of the composition even upon standing at high temperatures for long time intervals. A second objective is to provide a method for the preparation of this silicone grease composition.

SUMMARY OF THE INVENTION

The present inventors discovered that the objectives of this invention can be achieved by the combination of a suitable thickener with a cured organosiloxane gel that has been liquified by being subjected to shearing forces.

DETAILED DESCRIPTION OF THE INVENTION

This invention provides a silicone grease composition comprising the product obtained by blending (I) an organosiloxane material resulting from liquefaction under shear of a crosslinked organosiloxane gel prepared by a hydrosilylation reaction between (a) an organopolysiloxane containing at least two silicon-bonded lower alkenyl radicals per molecule, where the quantity of said organohydrogenpolysiloxane provides from 0.3 to 1.1 silicon-bonded hydrogen atoms per lower alkenyl radical present in said organopolysiloxane, and (b) an organohydrogenpolysiloxane containing at least two silicon-bonded hydrogen atoms per molecule, and (II) a thickener selected from the group consisting of fumed silica, hydrophobicized fumed silica, precipitated silica, hydrophobicized precipitated silica, fused silica, finely divided quartz, diatomaceous earth, talc, calcium carbonate, zinc oxide, titanium dioxide, ferric oxide, glass fiber, glass beads, glass balloons, alumina, silicon carbide, nitrogen carbide, aluminum nitride, boron nitride, manganese carbonate, carbon black, graphite, cerium hydroxide, and powdered polytetrafluoroethylene, This invention also provides a method for preparing an silicone grease by blending a suitable thickener with a crosslinked organosiloxane gel that has been liquified by application of shearing forces either prior to or during blending of the gel with the thickener.

The silicone grease composition of the present invention consists essentially of (I) a liquified crosslinked organosiloxane gel and (II) a thickener.

The liquified crosslinked organosiloxane gel (I) is the main or base ingredient of the present composition. This ingredient is obtained by liquefaction under shear of the crosslinked gel resulting from a hydrosilylation reaction between (a) an liquid organopolysiloxane having at least 2 silicon-bonded lower alkenyl groups in each molecule and (b) a liquid organopolysiloxane having at least 2 silicon-bonded hydrogen atoms in each molecule.

Within the context of the present invention, organosiloxane gel is a crosslinked material whose hardness value prior to liquefaction can be measured in accordance with the procedure for measuring penetration values described in Japanese Industrial Standard (JIS) K 2220.

The organopolysiloxane identified as ingredient (a) in the present specification must contain at least 2 silicon-bonded lower alkenyl radicals in each molecule. Its molecular structure may be any of straight chain, branched, and network, with straight chain polymers being the preferred species, followed by branched chain polymers. Ingredient (a) is preferably a straight-chain organopolysiloxane having a viscosity of 10 to 100,000 centipoise at 25° C. Ingredient (a) is too volatile when its viscosity is below 10 centipoise, which will make the composition unstable.

On the other hand, blending the liquified gel with the thickener becomes increasingly difficult when the viscosity of ingredient (a) is too high. The silicon-bonded lower alkenyl radical in this ingredient is exemplified by but not limited to vinyl, allyl, butenyl, and hexenyl with vinyl being preferred.

The concentration of lower alkenyl radicals in each molecule of ingredient (a) is preferably from 0.4 to 2.0 weight percent. The silicone grease composition will suffer from large oil bleeds at concentrations below 0.4 weight %, while exceeding 2.0 weight % results in such an excessive degree of crosslinking that the product is not even a gel, much less a grease. Other than the Si-bonded lower alkenyl radical, the silicon-bonded organic groups in ingredient (a) are exemplified by but not limited to alkyl radicals such as methyl, ethyl, propyl, and butyl; cycloalkyl radicals such as cyclopentyl and cyclohexyl; aryl radicals such as phenyl and xylyl; aralkyl radicals such as phenylethyl and phenylpropyl; and haloalkyl radicals such as gamma-chloropropyl and 3,3,3-trifluoropropyl.

The silicon-bonded lower alkenyl radicals can be present at any position within the molecule, but are preferably present on at least at the terminal positions of the molecule. The terminal groups in ingredient (a) are exemplified by hydroxyl, alkoxy and by triorganosiloxy groups such as trimethylsiloxy, dimethylvinylsiloxy, dimethylphenylsiloxy, and methylvinylphenylsiloxy.

The nature of the silicon-bonded organic groups in ingredient (a), the nature of the terminal groups, and the viscosity of this ingredient are not critical, and are typically selected based on the intended end use application of the ultimate silicone grease composition.

The organohydrogenpolysiloxane identified as ingredient (b) of the present compositions is a crosslinker which participates in a hydrosilylation reaction with ingredient (a). This ingredient must contain at least 2 silicon-bonded hydrogen atoms in each molecule. Ingredient (b) can be linear, cyclic, or exhibit network, and it may be a homopolymer or copolymer. The viscosity of ingredient (b) is preferably in the range of 1 to 10,000 centipoise at 25° C. The silicon-bonded organic groups in ingredient (b) are exemplified by monovalent hydrocarbon radicals other than lower alkenyl radicals. Suitable radicals include but are not limited to alkyl radicals methyl, ethyl, and butyl; aryl radicals phenyl and tolyl; and halogen-substituted alkyl radicals such as 3,3,3-trifluoropropyl.

The concentration of ingredient (b) in the present compositions is equivalent to an average of 0.3 to 1.1 silicon-bonded hydrogens in this ingredient (b) per Si-bonded lower alkenyl radical in ingredient (a). This is typically achieved by the addition of 0.3 to 40 weight parts of ingredient (b) per 100 weight parts of ingredient (a).

At less than 0.3 weight parts of ingredient (b) per 100 weight parts of ingredient (a), the silicone grease composition product will be insufficiently crosslinked and will thus suffer from a large oil separation. On the other hand, exceeding 40 weight parts results in an excessive crosslinking which precludes obtaining the silicone composition in a grease form.

The liquified organosiloxane gel identified as ingredient I of the present compositions is obtained by the shear-induced liquefaction of the crosslinked gel resulting from a hydrosilylation reaction between ingredients (a) and (b) in the presence of a hydrosilylation reaction catalyst, referred to in this specification as ingredient (c). Platinum metal and platinum compounds are typically used for this purpose.

Useful platinum-containing catalysts include but are not limited to finely divided elemental platinum, finely divided platinum dispersed on carbon powder, chloroplatinic acid, chloroplatinic acid/olefin coordination compounds, and chloroplatinic acid/vinylsiloxane coordination compounds. Other metals from the platinum group of the periodic table and compounds of these metals, such as tetrakis(triphenylphosphine)palladium and rhodium compounds can be used in place of the platinum-containing hydrosilylation catalysts.

The concentration of ingredient (c) is typically from 0.1 to 1,000 weight parts, based on the platinum content of this ingredient, per 1,000,000 weight parts of ingredient (a), and preferably within the range of 0.5 to 200 weight parts on the same basis.

Ingredient I is typically prepared by first producing the crosslinked gel and then processing it in a shearing stirrer or mixer such as a three-roll mill, two-roll mill, side grinder, or Ross mixer. However, this ingredient can also be prepared by conducting the hydrosilylation reaction between components (a) and (b) while applying shear to the reaction mixture using a mixer as described in the preceding paragraphs.

The thickener referred to in this specification as ingredient II is selected from the group consisting of fumed silica, hydrophobicized fumed silica, precipitated silica, hydrophobicized precipitated silica, fused silica, finely divided quartz, diatomaceous earth, talc, calcium carbonate, zinc oxide, titanium dioxide, ferric oxide, glass fiber, glass beads, glass balloons, alumina, silicon carbide, nitrogen carbide, aluminum nitride, boron nitride, manganese carbonate, carbon black, graphite, cerium hydroxide, and powdered polytetrafluoroethylene.

Ingredient II should be selected in accordance with the intended application of the ultimate silicone grease composition product. Thus, for example, when one is seeking to equip the composition with thermal conductivity, the use will be preferred of a strongly thermally conductive thickener such as alumina, silicon carbide, aluminum nitride, or boron nitride. On the other hand, when one is seeking to impart electrical conductivity, a thickener with an excellent electrical conductivity, e.g., carbon black or graphite, recommends itself.

The concentration of ingredient II in the present compositions is not specifically restricted. The concentration of this ingredient is typically 10 to 1,000 weight parts per 100 weight parts of organosiloxane gel, ingredient I in order to obtain a composition in the form of a grease.

The present silicone grease compositions may also contain one or more optional ingredients based on the intended application. These optional ingredients include but are not limited to pigments, organic solvents, heat stabilizers and antioxidants.

Even in the case of thickeners with large particle sizes, oil bleed from a silicone grease composition according to the present invention is inhibited to minimal levels, typically less than 1 percent, based on the weight of the grease composition. This ensures achieving a low level of oil-bleed not only in the case of compositions containing small-diameter fumed silicas and hydrophobicized fumed silicas, but also even in the case of thickeners such as alumina, nitrogen carbide, aluminum nitride, and boron nitride, all of which have relative large particle sizes.

One method for preparing the present silicone grease compositions involves conducting a hydrosilylation reaction between ingredients (a) and (b) in the presence of ingredients (c) and II while applying a shearing force to the mixture of sufficient magnitude to liquify the cured gel.

The method for preparing the present grease compositions will now be explained in greater detail.

In accordance with one embodiment of the present method a hydrosilylation reaction is conducted by blending ingredients (a), (b), (c), and II while mixing them in a shearing stirrer or mixer such as a three-roll mill, two-roll mill, side grinder, Ross mixer, or planetary mixer, and so forth. Neither the mixer nor the sequence is specifically restricted, so long as it can apply sufficient shear to liquify the cured organosiloxane gel referred to as ingredient I.

The hydrosilylation reaction proceeds even at room temperature, although it may be accelerated by heating. Heating is in fact preferred in order to obtain a thorough mixing of ingredients (a), (b), (c) and II. The generally recommended method comprises mixing in a planetary mixer, or equivalent device with heating to at least 100° C., preferably at about 150°. Depending upon the amount of material being precessed, from 30 minutes to about three hours of heating is sufficient to achieve complete curing of the composition.

Ingredients (a), (b), (c), and II may all be mixed at once, but it is also permissible to mix and heat ingredients (a) and II in a preliminary step and then to add ingredients (b) and (c) and prepare the cured gel. The mixing step can also be conducted under reduced pressure.

If the hydrosilylation reaction is allowed to proceed too rapidly, the resulting silicone grease composition will not be a smooth, slippery grease. As a consequence, the heating should be carefully controlled or a small quantity of a reaction inhibitor should be added in order to inhibit the hydrosilylation reaction. Examples of these reaction inhibitors are acetylenic compounds, compounds containing alkenyl radicals, triazoles, hydrazines, phosphines, and mercaptans.

Furthermore, the present method can optionally use a thickener (Ingredient II) whose surface has been hydrophobicized by treatment with an organosilicon compound such as, for example, hexamethyldisilazane, trimethylsilylacetamide, methyltrimethoxysilane, dimethyldimethoxysilane, trimethylchlorosilane, or methyltrichlorosilane. The thickener can be treated with the organosilicon compound in a preliminary step, or the organosilicon compound may be added to the composition at the point at which ingredients (a) and II are combined.

In accordance with an alternative embodiment of the present method the shearing force required to liquify the crosslinked gel is applied during blending of the gel with the thickener (ingredient II).

EXAMPLES

The following examples describe preferred embodiments of the present grease compositions and the method for preparing them, and should not be interpreted as limiting the scope of the present invention as described in the accompanying claims. Unless other wise indicated, all parts and percentages in the examples are by weight and viscosities were measured at 25° C.

EXAMPLE 1

100 Parts of a dimethylvinylsiloxy-terminated dimethylpolysiloxane exhibiting a viscosity of 500 centipoise, 300 parts of alumina powder with average particle size of 2.2 micrometers, 300 parts alumina powder with average particle size of 22 micrometers, and 3 parts hexamethyldisilazane were introduced into a planetary mixer and blended. The temperature of the mixture was raised to 150° C. and the mixer chamber was evacuated. After thorough mixing for one hour followed by cooling, 7 parts of a trimethylsiloxy-terminated methylhydrogenpolysiloxane with viscosity of 20 centipoise, an amount equivalent to 0.45 Si-bonded hydrogen atoms in the methylhydrogenpolysiloxane per vinyl group in the dimethylpolysiloxane, and an amount of isopropanolic chloroplatinic acid solution equivalent to 10 ppm as platinum metal based on the weight of the dimethylpolysiloxane were added to the mixer chamber.

The contents of the mixer chamber were blended to homogeneity and then heated at 150° C. for 30 minutes. The contents of the mixer chamber were then cooled to yield a silicone grease composition of the present invention.

The final silicone grease composition had a viscosity of 5,000 poise. An oil bleed of 0.01 weight % was measured when the composition was heated at 150° for 24 hours as described in specification MIL 8660 B. The thermal conductivity of this silicone grease composition was $4.2\times10-3$ cal/cm.sec.°C. using a Shotherm QTM-D2 from Showa Denko Kabushiki Kaisha.

REFERENCE EXAMPLE 1

This example demonstrates the properties of the cured gel described in Example 1 that has not been liquefied. The ingredients used to prepare the composition described in Example 1 were mixed without heating and subsequently placed in an oven maintained at 150° C. The resultant crosslinked gel lacked fluidity. The penetration value of this crosslinked gel was 68, and was measured in accordance with JIS K 2220.

COMPARISON EXAMPLE 1

This example demonstrates the adverse effects of using an uncured organosiloxane material in a grease composition. The following ingredients were blended using a planetary mixer: 100 parts of a dimethylvinylsiloxy-terminated dimethylpolysiloxane with a viscosity of 2,000 centipoise, 300 parts alumina powder with an average particle size of 2.2 micrometers, 300 parts alumina powder with an average particle size of 22 micrometers, and 3 parts of hexamethyldisilazane. The mixing chamber was evacuated and the contents of the chamber were maintained at 150° C. for one hour. Cooling yielded a silicone grease composition outside the scope of the present invention.

This silicone grease composition had a viscosity of 3,000 poise. An oil bleed of 1.0 weight % was measured using the conditions specified in MIL 8660 B. The thermal conductivity of this silicone grease composition was measured at $4.2\times10-3$ cal/cm. sec .° C. using a Shotherm QTM-D2 from Showa Denko Kabushiki Kaisha.

COMPARISON EXAMPLE 2

This example demonstrates the effect of exceeding the preferred upper limit of 1.1 for the molar ratio of silicon-bonded hydrogen atoms to alkenyl radicals in the curable organosiloxane composition. The following ingredients were blended using a planetary mixer: 100 parts of dimethylvinylsiloxy-terminated dimethylpolysiloxane with a viscosity of 500 centipoise, 300 parts of alumina powder with an average particle size of 2.2 micrometers, 300 parts alumina powder with average particle size of 22 micrometers, and 3 parts hexamethyldisilazane. The mixing chamber was evacuated and temperature of the mixture was raised to 150° C. for one hour. After cooling, 17 parts trimethylsiloxy-terminated methylhydrogenpolysiloxane with a viscosity of 20 centipoise, an amount equivalent to 1.2 Si-bonded hydrogen atoms in the methylhydrogenpolysiloxane per vinyl radical in the dimethylpolysiloxane, and a quantity of an isopropanolic chloroplatinic acid solution equivalent to 10 ppm as platinum metal based on the weight of the dimethylpolysiloxane, were added. This was followed by blending the ingredients to homogeneity and then heating them to 150° C. for 30 minutes with mixing. Cooling of the composition in the mixer chamber yielded a cured gel rather than a grease composition of the present invention.

REFERENCE EXAMPLE 2

The ingredients employed in Comparison Example 2 were mixed without heating in a planetary mixer to give a curable organosiloxane composition. This composition was then heated in an oven maintained at 150° C. to give a rubbery crosslinked material. This crosslinked product had a hardness value of 30 using a JIS A hardness meter.

EXAMPLE 2

The following ingredients were blended using a planetary mixer: 100 parts of a dimethylpolysiloxane exhibiting a viscosity of 1,000 centipoise and terminated with dimethylvinylsiloxy and trimethylsiloxy at a 1:1 ratio on the average and 110 parts boron nitride powder with average particle size=50 micrometers. The mixer chamber was then evacuated and the temperature in the mixer chamber raised to 150° C. for one hour. After cooling, 0.4 parts trimethylsiloxy-terminated methylhydrogenpolysiloxane with a viscosity of 10 centipoise, an amount equivalent to 0.7 Si-bonded hydrogen atoms in the methylhydrogenpolysiloxane per vinyl radical in the dimethylpolysiloxane, and a quantity of isopropanolic chloroplatinic acid solution equivalent to 10 ppm as platinum metal based on the weight of the dimethylpolysiloxane were added followed by mixing to homogeneity. The resultant composition was then blended while being heated to 150° C. for 30 minutes. A silicone grease composition of the present invention was obtained upon cooling the resultant mixture. The grease composition had a viscosity of 10,000 poise and an oil bleed of 0.3 weight percent, measured using the conditions in MIL 8660 B (150° C., 24 hours).

The thermal conductivity of this silicone grease composition was measured as $3.0\times10-3$ cal/cm. sec .° C. using a Shotherm QTM-D2 from Showa Denko Kabushiki Kaisha.

REFERENCE EXAMPLE 3

The ingredients employed in Example 2 were mixed in a planetary mixer without heating to give a silicone composition. This composition was converted to a crosslinked gel during heating in an oven at 150° C. for 30 minutes. The penetration value of this crosslinked gel was 100, measured using the procedure described in JIS K 2220.

COMPARISON EXAMPLE 3

The following ingredients were blended using a planetary mixer: 100 parts of a dimethylpolysiloxane exhibiting a viscosity of 1,000 centipoise and terminated with dimethylvinylsiloxy groups and trimethylsiloxy groups in a 1:1 molar ratio on average and 110 parts boron nitride powder with average particle size=50 micrometers. The mixer chamber was then evacuated and the contents heated at a temperature of 150° C. for one hour. The resultant silicone composition had a viscosity of 2,000 poise. The oil bleed of the composition was 3.0 weight %, measured using the conditions in MIL 8660 B (150° C., 24 hours). The thermal conductivity of this silicone grease composition was measured at $3.0\times10-3$ cal/cm. sec .° C. using a Shotherm QTM-D2 from Showa Denko Kabushiki Kaisha.

That which is claimed is:

1. A silicone grease composition consisting essentially of the product obtained by blending under shear (I) a liquified crosslinked organosiloxane gel obtained by curing a composition comprising (a) an organopolysiloxane containing at least two silicon-bonded lower alkenyl radicals per molecule, (b) an organohydrogenpolysiloxane containing at least two silicon-bonded hydrogen atoms per molecule, where the quantity of said organohydrogenpolysiloxane provides from 0.3 to 1.1 silicon-bonded hydrogen atoms per lower alkenyl radical present in said organopolysiloxane, and (c) a hydrosilation reaction catalyst and (II) a thickener selected from the group consisting of fumed silica, hydrophobicized fumed silica, precipitated silica, hydrophobicized precipitated silica, fused silica, finely divided quartz, diatomaceous earth, talc, calcium carbonate, zinc oxide, titanium dioxide, ferric oxide, glass fiber, glass beads, glass balloons, alumina, silicon carbide, nitrogen carbide, aluminum nitride, boron nitride, manganese carbonate, carbon black, graphite, cerium hydroxide, and powdered polytetrafluoroethylene, where the oil bleed from said grease composition is equivalent to less than 1 percent by weight of the composition.

2. A composition according to claim 1 where the silicon-bonded organic groups in said crosslinked gel and said organohydrogenpolysiloxane are alkyl, phenyl or 3,3,-trifluoropropyl, said alkenyl radicals are vinyl, the viscosity of said organopolysiloxane is from 50 to 100,000 centipoise at 25° C., the viscosity of said organohydrogenpolysiloxane is from 1 to 10,000 centipoise at 25° C., and the concentration of said thickener is from 10 to 10,000 weight parts per 100 weight parts of said crosslinked gel.

3. A composition according to claim 1 where said crosslinked gel is formed in the presence of said thickener.

4. A composition according to claim 1 where said crosslinked gel is prepared prior to being liquified under shear in the presence of said thickener.

5. A method of preparing a silicone grease composition exhibiting an oil bleed equivalent to less than 1 percent by weight of said composition, said method comprising blending to homogeneity a mixture comprising (I) a liquified crosslinked organasiloxane gel obtained by the reaction of (a) an organopolysiloxane having at least two silicone-bonded lower alkenyl radicals in each molecule, (b) an organohydrogenpolysiloxane containing at least two silicon-bonded hydrogen atoms in each molecule, the concentration of said organohydrogenpolysiloxane being equivalent to from 0.3 to 1.1 silicon-bonded hydrogen atoms per lower alkenyl radical in said organopolysiloxane, and (c) a quantity of a hydrosilylation reaction catalyst sufficient to cure said composition to a crosslinked gel, and (II) a thickener selected from the group consisting of fumed silica, hydrophobicized fumed silica, precipitated silica, hydrophobicized precipitated silica, fused silica, finely divided quartz, diatomaceous earth, talc, calcium carbonate, zinc oxide, titanium dioxide, ferric oxide, glass fiber, glass beads, glass balloons, alumina, silicon carbide, nitrogen carbide, aluminum nitride, boron nitride, manganese carbonate, carbon black, graphite, cerium hydroxide, and powdered polytetrafluoroethylene;

where the shearing force applied during blending of said gel with said thickener is sufficient to liquify said gel.

6. A method according to claim 5 where the silicon-bonded organic groups in said organopolysiloxane and said organohydrogenpolysiloxane are alkyl, phenyl or 3,3,-trifluoropropyl, said alkenyl radicals are vinyl, the viscosity of said organopolysiloxane is from 50 to 100,000 centipoise at 25° C., the viscosity of said organohydrogenpolysiloxane is from 1 to 10,000 centipoise at 25° C., and the concentration of said thickener is from 10 to 10,000 weight parts per 100 weight parts of said crosslinked gel.

7. A method according to claim 5 where said crosslinked gel is formed in the presence of said thickener.

8. A composition according to claim 5 where said crosslinked gel is prepared prior to being liquified under shear in the presence of said thickener.

* * * * *